US010557401B2

(12) United States Patent
Bilancia et al.

(10) Patent No.: US 10,557,401 B2
(45) Date of Patent: Feb. 11, 2020

(54) THERMAL MANAGEMENT SYSTEMS, COOLANT VALVES AND CONTROL LOGIC FOR VEHICLE POWERTRAINS

(71) Applicant: GM GLOBAL TECHNOLOGY OPERATIONS LLC, Detroit, MI (US)

(72) Inventors: Michele Bilancia, Turin (IT); Eugene V. Gonze, Pinckney, MI (US); Lawrence P. Ziehr, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 270 days.

(21) Appl. No.: 15/633,314

(22) Filed: Jun. 26, 2017

(65) Prior Publication Data

US 2018/0371982 A1 Dec. 27, 2018

(51) Int. Cl.

| | |
|---|---|
| ***F01P 7/16*** | (2006.01) |
| ***F01P 5/12*** | (2006.01) |
| ***F02F 1/40*** | (2006.01) |
| ***F02M 26/28*** | (2016.01) |
| *F02B 77/08* | (2006.01) |

(52) U.S. Cl.

CPC ..... *F01P 7/167* (2013.01); *F01P 5/12* (2013.01); *F02F 1/40* (2013.01); *F02M 26/28* (2016.02); *F02B 77/082* (2013.01)

(58) Field of Classification Search

CPC combination set(s) only.

See application file for complete search history.

(56) References Cited

U.S. PATENT DOCUMENTS

| | | | |
|---|---|---|---|
| 5,105,784 | A | 4/1992 | Davis et al. |
| 5,765,537 | A | 6/1998 | Coleman et al. |
| 6,119,652 | A | 9/2000 | Waples et al. |
| 7,845,337 | B2 | 12/2010 | Song |
| 8,402,776 | B2 | 3/2013 | Johnston et al. |
| 8,413,434 | B2 | 4/2013 | Prior et al. |

(Continued)

OTHER PUBLICATIONS

US 5,260,544 A1, 07/2001, Spry et al. (withdrawn)

(Continued)

*Primary Examiner* — Kevin A Lathers

(74) *Attorney, Agent, or Firm* — Quinn IP Law

(57) ABSTRACT

Disclosed are two-valve, split-layout engine cooling systems, methods for making and method for operating such cooling systems, engine coolant valve assembly configurations, and vehicles equipped with an active thermal management system for cooling select powertrain components. A disclosed thermal management system includes a radiator for cooling coolant fluid, and a coolant pump for circulating coolant fluid received from the radiator. A set of conduits fluidly connect the coolant pump to an engine block, a cylinder head, and an exhaust manifold. Another set of conduits fluidly connect the engine block, cylinder head, and exhaust manifold to the radiator, coolant pump, and one or more oil heaters. A first valve assembly is operable to regulate coolant flow between the coolant pump and the radiator. A second valve assembly is operable to regulate coolant fluid flow, individually and jointly, between the engine block, cylinder head, exhaust manifold, radiator, coolant pump, and oil heater(s).

20 Claims, 3 Drawing Sheets

(56) References Cited

U.S. PATENT DOCUMENTS

| | | | | |
|---|---|---|---|---|
| 9,188,051 | B1 * | 11/2015 | Zahdeh | F01N 5/02 |
| 9,523,307 | B2 * | 12/2016 | Lee | F01P 7/165 |
| 2006/0236693 | A1 * | 10/2006 | Wei | F02B 37/013 60/605.1 |
| 2009/0255488 | A1 * | 10/2009 | Shiobara | F01P 7/167 123/41.1 |
| 2011/0192844 | A1 | 8/2011 | Erdmann et al. | |
| 2015/0101549 | A1 | 4/2015 | Bilancia | |

OTHER PUBLICATIONS

Losano et al., Details on 5 Diesel Engines, Wien Motorsymposium 2015, 2 pages.

Neuber, et al. Volkswagen's new modular TDI© generation, Internationales Wiener Motorensymposium 2012, 26 pages.

Steinparzer, et al. The New Six-Cylinder Diesel Engines from the BMW In-Line Engine Module, 24th Aachen Colloquium Automobile and Engine Technology 2015, pp. 31-49, Steyr, Austria.

* cited by examiner

THERMAL MANAGEMENT SYSTEMS, COOLANT VALVES AND CONTROL LOGIC FOR VEHICLE POWERTRAINS

INTRODUCTION

The present disclosure relates generally to motor vehicle powertrains. More specifically, aspects of this disclosure relate to coolant valve layouts and related control logic for active thermal management systems of internal combustion engine assemblies.

Current production motor vehicles, such as the modern-day automobile, are originally equipped with a powertrain that operates to propel the vehicle and power the onboard vehicle electronics. In automotive applications, for example, the powertrain is generally typified by a prime mover that delivers driving power through a multi-speed power transmission to the vehicle's final drive system (e.g., rear differential, axles, and road wheels). Automobiles have traditionally been powered by a reciprocating-piston type internal combustion engine assembly because of its ready availability and relatively inexpensive cost, light weight, and overall efficiency. Such engines include compression-ignited (CI) diesel engines, spark-ignited (SI) gasoline engines, flex-fuel models, two, four and six-stroke architectures, and rotary engines, as some non-limiting examples. Hybrid and full-electric vehicles, on the other hand, utilize alternative power sources, such as fuel-cell or battery powered electric motor-generators, to propel the vehicle and minimize/eliminate reliance on an engine for power.

During normal operation, internal combustion engine (ICE) assemblies and large traction motors (i.e., for hybrid and full-electric powertrains) generate a significant amount of heat that is radiated into the vehicle's engine compartment. To prolong the operational life of the prime mover(s) and the various components packaged within the engine compartment, most automobiles are equipped with passive and active features for managing heat in the engine bay. Passive measures for alleviating excessive heating within the engine compartment include, for example, thermal wrapping the exhaust runners, thermal coating of the headers and manifolds, and integrating thermally insulating packaging for heat sensitive electronics. Active means for cooling the engine compartment include high-performance radiators, high-output coolant pumps, and electric cooling fans. As another option, some vehicle hood assemblies are provided with active or passive air vents designed to expel hot air and amplify convective cooling within the engine bay.

Active thermal management systems for automotive powertrains normally employ an onboard vehicle controller or electronic control module to regulate operation of a cooling circuit that distributes liquid coolant, generally of oil, water, and/or antifreeze, through heat-producing powertrain components. A coolant pump propels the cooling fluid—colloquially known as "engine coolant"—through coolant passages in the engine block, coolant passages in the transmission case and sump, and hoses to a radiator or other heat exchanger. A heat exchanging radiator cools hot engine coolant by rapidly convecting heat to ambient air. Many modern thermal management systems use a split cooling system layout that features separate circuits and water jackets for the cylinder head and engine block such that the head can be cooled independently from the block. The cylinder head, which has a lower mass than the engine block and is exposed to very high temperatures, heats up much faster than the engine block and, thus, generally needs to be cooled first. Advantageously, during warm up, a split layout allows the system to first cool the cylinder head and, after a given time interval, then cool the engine block.

SUMMARY

Disclosed herein are multi-valve, split-layout cooling systems and related control logic for thermal management of select vehicle powertrain components, methods for making and methods for operating such cooling systems, and vehicles equipped with an active thermal management (ATM) system for cooling the powertrain's engine assembly and other select components. By way of example, and not limitation, there is presented a novel "smart" cooling system with a two-valve coolant circuit layout that provides the same thermal management capabilities as three and four-valve systems. This coolant valve architecture integrates the functionalities of multiple coolant control valves—one valve for engine management and one valve for heatsink management—into a single control valve assembly. In a more specific example, a Main Rotary Valve (MRV) assembly is fabricated with coolant inlet ports for individually controlling coolant flow discharged from the engine block, cylinder head, and exhaust manifold, as well as coolant outlet ports for individually controlling coolant flow distributed to the transmission oil heater, engine oil heater, heater core, coolant pump, and radiator. This simplified system does not require modification to existing engine cooling jackets or existing radiator, turbocharger, and exhaust gas recirculation (EGR) hardware.

Attendant benefits for at least some of the disclosed concepts include simplified thermal management systems with fewer coolant system components, which results in lower system costs and reduced packaging space requirements. Disclosed two-valve ATM layouts may leverage available coolant system software and hardware with reduced circuit complexity, thus minimizing the impact on functional configurability and calibration of the ATM system. Aspects of the disclosed concepts also help to ensure optimal operating temperatures, better combustion conditions, faster warm up, and reduced specific consumption and emissions. Simplified two-valve, split-layout systems presented herein can be adapted for implementation into gasoline and diesel engines, as well as for manually operated and automatic transmission powertrains.

Aspects of the present disclosure are directed to active thermal management systems for regulating the operating temperatures of select powertrain components. Disclosed, for example, is a thermal management system for a vehicle powertrain with an engine assembly and one or more oil heaters. This thermal management system includes an electronic heat exchanger, such as a convective-cooling radiator, that actively transfers heat energy from a coolant fluid to an ambient fluid. A coolant pump, which may be driven by the engine crankshaft or a dedicated motor, circulates the coolant fluid emitted from the electronic heat exchanger. A first set of fluid conduits fluidly connects the coolant pump to the electronic heat exchanger. Additionally, a second set of fluid conduits include discrete lines for fluidly connecting the coolant pump to the engine block, cylinder head, and exhaust manifold. In the same vein, a third set of fluid conduits include discrete lines for fluidly connecting the engine block, cylinder head, and exhaust manifold to the electronic heat exchanger, coolant pump, and the oil heater(s). A first valve assembly, which may be in the nature of an electronic rotary valve, is interposed within the first set of fluid conduits and operable to regulate coolant fluid flow between the coolant pump and electronic heat exchanger.

Likewise, a second valve assembly, which may also be rotary-type valve, is interposed within the third set of fluid conduits and operable to regulate coolant fluid flow, individually and jointly, between the engine block, cylinder head, exhaust manifold, electronic heat exchanger, coolant pump, and oil heater(s).

Other aspects of the present disclosure are directed to motor vehicles equipped with an active thermal management system for cooling a reciprocating-piston-type engine assembly and an epicyclic power transmission. A "motor vehicle," as used herein, may include any relevant vehicle platform, such as passenger vehicles (ICE, hybrid electric, fuel cell hybrid, fully or partially autonomous, etc.), commercial vehicles, industrial vehicles, tracked vehicles, off-road and all-terrain vehicles (ATV), farm equipment, boats, airplanes, etc. A motor vehicle is presented that includes a vehicle body, and an ICE assembly mounted inside an engine compartment of the vehicle body. The ICE assembly includes a cylinder head mounted on an engine block, and an exhaust manifold attached to or integrally formed with the cylinder head. A multi-speed power transmission is operable to transmit torque output by the ICE assembly to one or more or all of the vehicle's drive wheels.

Continuing with the above example, the motor vehicle also includes a radiator that is selectively operable to transfer heat from coolant fluid to ambient air. A coolant pump circulates the coolant fluid cooled by and emitted from the radiator. The vehicle includes a first set of conduits that fluidly connect the coolant pump to the radiator, and a second set of conduits that fluidly connect the coolant pump to the engine block, cylinder head, and exhaust manifold. A third set of fluid conduits fluidly connect the engine block, cylinder head, and exhaust manifold to the radiator, coolant pump, a transmission oil heater, and an engine oil heater. A first valve assembly, which is interposed within the first set of fluid conduits, is selectively operable to regulate coolant fluid flow between the coolant pump and radiator. In addition, a second valve assembly, which is interposed within the third set of fluid conduits, is selectively operable to regulate coolant fluid flow, individually and jointly, between the engine block, cylinder head, exhaust manifold, radiator, coolant pump, and oil heaters.

Additional aspects of the present disclosure are directed to methods for making and methods for assembling any of the disclosed thermal management systems and corresponding motor vehicles and vehicle powertrains. Aspects of the present disclosure are also directed to methods for operating disclosed motor vehicles and thermal management systems. Also presented herein are non-transitory, computer readable media storing instructions executable by at least one of one or more processors of one or more in-vehicle electronic control units, such as a programmable engine control unit (ECU) or powertrain control module (PCM), to govern operation of a disclosed thermal management system.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of illustrative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
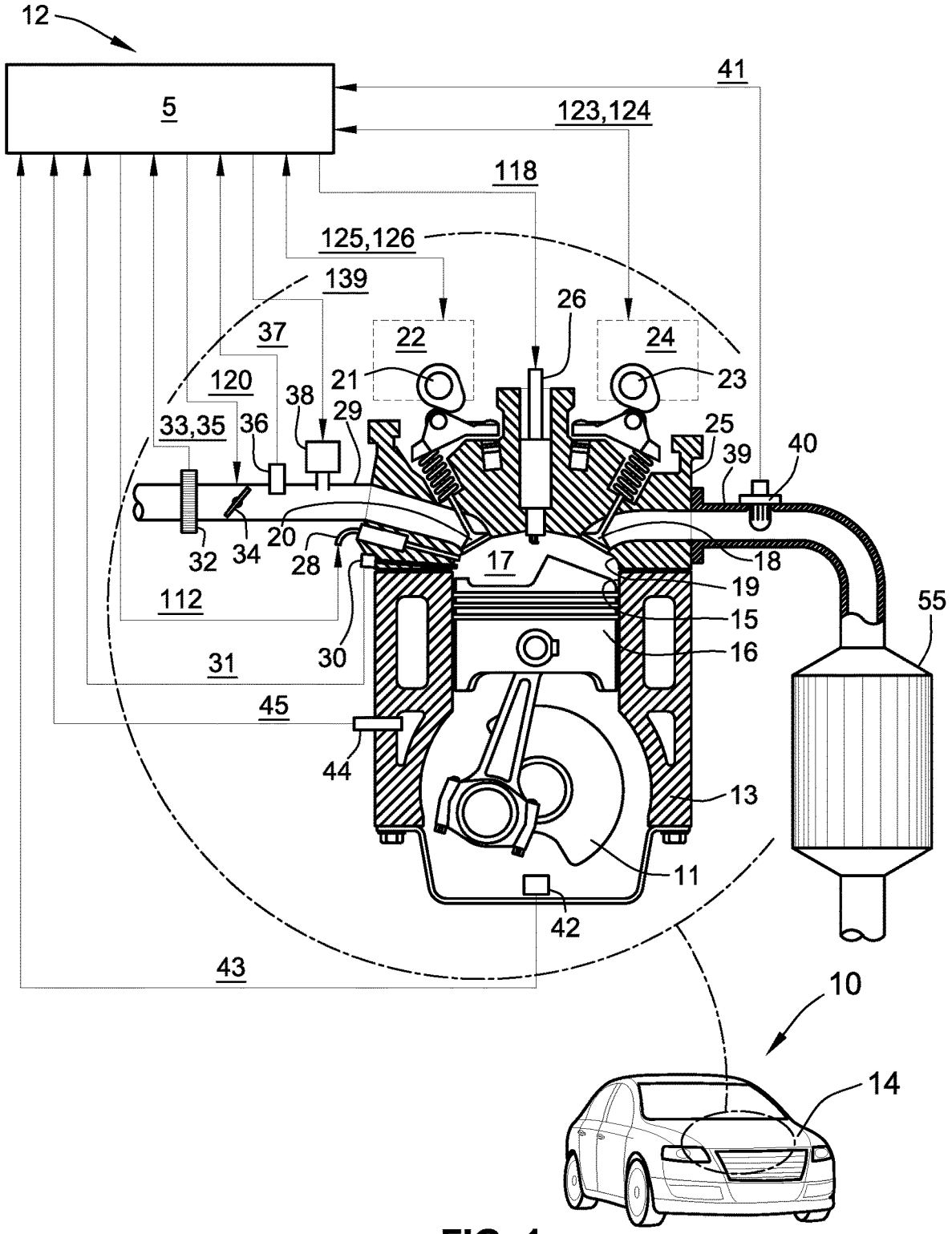
FIG. 1 is a front perspective-view illustration of a representative motor vehicle with an inset schematic illustration of a representative reciprocating-piston type internal combustion engine (ICE) assembly in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, permutations, groupings, and alternatives falling within the scope of this disclosure as defined by the appended claims.

DETAILED DESCRIPTION

This disclosure is susceptible of embodiment in many different forms. There are shown in the drawings and will herein be described in detail representative embodiments of the disclosure with the understanding that these illustrated examples are to be considered an exemplification of the disclosed principles and do not limit the broad aspects of the disclosure to the representative embodiments. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" and synonyms thereof mean "including without limitation." Moreover, words of approximation, such as "about," "almost," "substantially," "approximately," and the like, may be used herein in the sense of "at, near, or nearly at," or "within 3-5% of," or "within acceptable manufacturing tolerances," or any logical combination thereof, for example.

Referring now to the drawings, wherein like reference numbers refer to like features throughout the several views, there is shown in FIG. 1 a perspective-view illustration of a representative automobile, which is designated generally at 10 and portrayed herein for purposes of discussion as a four-door sedan-style passenger vehicle. Mounted at a forward portion of the automobile's 10 body, e.g., aft of a front bumper fascia and grille and forward of a passenger compartment, is an internal combustion engine (ICE) assembly 12 housed within an engine compartment covered by an engine hood 14. The illustrated automobile 10—also referred to herein as "motor vehicle" or "vehicle" for short—is merely an exemplary application with which novel aspects and features of this disclosure may be practiced. In the same vein, the implementation of the present concepts into a spark-ignited direct-injection (SIDI) engine configuration should also be appreciated as an exemplary application of the novel concepts disclosed herein. As such, it will be understood that many aspects and features of the present disclosure may be applied to additional engine configurations, implemented for other powertrain architectures, and utilized for any logically relevant type of motor vehicle. Lastly, the drawings presented herein are not necessarily to scale and are provided purely for instructional purposes. Thus, the specific and relative dimensions shown in the drawings are not to be construed as limiting.

There is shown in FIG. 1 an example of a multi-cylinder, dual overhead cam (DOHC), inline-type engine assembly 12. The illustrated ICE assembly 12 is a four-stroke, reciprocating-piston engine configuration that operates to propel the vehicle 10, for example, as a direct injection gasoline engine, including flexible-fuel vehicle (FFV) and hybrid vehicle variations thereof. The ICE assembly 12 may optionally or alternatively operate in any of an assortment of combustion modes, including a selectable homogeneous-charge compression-ignition (HCCI) combustion mode and other compression ignited combustion modes. Additionally, the ICE assembly 12 may operate at a stoichiometric air/fuel ratio and/or at an air/fuel ratio that is primarily lean of stoichiometry. This engine 12 includes a series of reciprocating pistons 16 slidably movable in cylinder bores 15 of an engine block 13. The top surface of each piston 16 cooperates with the inner periphery of its corresponding cylinder 15 and a recessed chamber surface 19 of a cylinder head 25 to define a variable-volume combustion chambers 17. Each piston 16 is connected to a rotating crankshaft 11 by which linear reciprocating motion of the pistons 16 is output as rotational motion, for example, to a multi-speed power transmission via a hydrokinetic torque converter, flywheel, etc.

An air intake system transmits intake air to the cylinders 15 through an intake manifold 29, which directs and distributes air into the combustion chambers 17, e.g., via intake runners of the cylinder head 25. The engine's air intake system has airflow ductwork and various electronic devices for monitoring and controlling the flow of intake air. The air intake devices may include, as a non-limiting example, a mass airflow sensor 32 for monitoring mass airflow (MAF) 33 and intake air temperature (IAT) 35. A throttle valve 34 controls airflow to the ICE assembly 12 in response to a control signal (ETC) 120 from a programmable engine control unit (ECU) 5. A pressure sensor 36 operatively coupled to the intake manifold 29 monitors, for instance, manifold absolute pressure (MAP) 37 and, if desired, barometric pressure. An optional external flow passage recirculates metered quantities of exhaust gas from engine exhaust to the intake manifold 29, e.g., via a control valve in the nature of an exhaust gas recirculation (EGR) valve 38. The programmable ECU 5 controls mass flow of exhaust gas to the intake manifold 29 by regulating the opening and closing of the EGR valve 38 via EGR command 139. In FIG. 1, the arrows interconnecting ECU 5 with the various components of the ICE assembly 12 are emblematic of electronic signals or other communication exchanges by which data and/or control commands are transmitted from one component to the other.

Airflow from the intake manifold 29 into each combustion chamber 17 is controlled by one or more dedicated engine intake valves 20. Evacuation of exhaust gases and other combustion byproducts from the combustion chamber 17 to an exhaust aftertreatment system 55 via an exhaust manifold 39 is controlled by one or more dedicated engine exhaust valves 18. In accord with at least some of the disclosed embodiments, exhaust aftertreatment system 55 includes an EGR system and/or a selective catalytic reduction (SCR) system. The engine valves 18, 20 are illustrated herein as spring-biased poppet valves; however, other known types of engine valves may be employed. The ICE assembly 12 valve train system is equipped to control and adjust the opening and closing of the intake and exhaust valves 20, 18. According to one example, the activation of the intake and exhaust valves 20, 18 may be respectively modulated by controlling intake and exhaust variable cam phasing/variable lift control (VCP/VLC) devices 22 and 24. These two VCP/VLC devices 22, 24 are configured to control and operate an intake camshaft 21 and an exhaust camshaft 23, respectively. Rotation of these intake and exhaust camshafts 21 and 23 are linked and/or indexed to rotation of the crankshaft 11, thus linking openings and closings of the intake and exhaust valves 20, 18 to positions of the crankshaft 11 and the pistons 16.

The intake VCP/VLC device 22 may be fabricated with a mechanism operative to switch and control valve lift of the intake valve(s) 20 in response to a valve lift control signal (iVLC) 125, and variably adjust and control phasing of the intake camshaft 21 for each cylinder 15 in response to a variable cam phasing control signal (iVCP) 126. In the same vein, the exhaust VCP/VLC device 24 may include a mechanism operative to variably switch and control valve lift of the exhaust valve(s) 18 in response to a valve lift control signal (eVLC) 123, and variably adjust and control phasing of the exhaust camshaft 23 for each cylinder 15 in response to a control signal (eVCP) 124. The VCP/VLC devices 22, 24 may be actuated using any one of electro-hydraulic, hydraulic, electro-mechanic, and electric control force, in response to respective control signals eVLC 123, eVCP 124, iVLC 125, and iVCP 126, for example.

With continuing reference to the representative configuration of FIG. 1, ICE assembly 12 employs a gasoline or diesel type direct injection (DI) fuel injection subsystem with multiple high-pressure fuel injectors 28 that directly inject pulses of fuel into the combustion chambers 17. Each cylinder 15 is provided with one or more fuel injectors 28, which activate in response to an injector pulse width command (INJ_PW) 112 from the ECU 5. These fuel injectors 28 are supplied with pressurized fuel by a fuel storage and distribution system (not shown). One or more or all of the fuel injectors 28 may be operable, when activated, to inject multiple fuel pulses (e.g., a succession of first, second, third, etc., injections of fuel mass) per working cycle into a corresponding one of the ICE assembly cylinders 15. The ICE assembly 12 employs a spark-ignition subsystem by which fuel-combustion-initiating energy—typically in the nature of an abrupt electrical discharge—is provided via a spark plug 26 for igniting, or assisting in igniting, cylinder charges in each of the combustion chambers 17 in response to a spark command (IGN) 118 from the ECU 5. Aspects and features of the present disclosure may be similarly applied to compression-ignited (CI) diesel engines.

The ICE assembly 12 is equipped with various sensing devices for monitoring engine operation, including a crank sensor 42 having an output indicative of, e.g., crankshaft crank angle, torque and/or speed (RPM) signal 43. A temperature sensor 44 is operable to monitor, for example, one or more engine-related temperatures (e.g., coolant fluid temperature, fuel temperature, exhaust temperature, etc.), and output a signal 45 indicative thereof. An in-cylinder combustion sensor 30 monitors combustion-related variables, such as in-cylinder combustion pressure, charge temperature, fuel mass, air-to-fuel ratio, etc., and output a signal 31 indicative thereof. An exhaust gas sensor 40 is configured to monitor an exhaust-gas related variables, e.g., actual air/fuel ratio (AFR), burned gas fraction, exhaust temperature, etc., and output a signal 41 indicative thereof.

The combustion pressure and the crankshaft speed may be monitored by the ECU 5, for example, to determine combustion timing, i.e., timing of combustion pressure relative to the crank angle of the crankshaft 11 for each cylinder 15 for each working combustion cycle. It should be appreciated that combustion timing may be determined by other methods. Combustion pressure may be monitored by the ECU 5 to determine an indicated mean effective pressure (IMEP) for each cylinder 15 for each working combustion cycle. The ICE assembly 12 and ECU 5 cooperatively monitor and determine states of IMEP for each of the engine cylinders 15 during each cylinder firing event. Alternatively, other sensing devices, arrangements, and systems may be used to monitor states of other parameters within the scope of the disclosure, e.g., ion-sense ignition systems, EGR fractions, and non-intrusive cylinder pressure sensors.

Control module, module, controller, control unit, electronic control unit, processor, and any permutations thereof may be defined to mean any one or various combinations of one or more of logic circuits, Application Specific Integrated Circuit(s) (ASIC), electronic circuit(s), central processing unit(s) (e.g., microprocessor(s)), and associated memory and storage (e.g., read only, programmable read only, random access, hard drive, tangible, etc.), whether resident, remote or a combination of both, executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms may be defined to mean any controller executable instruction sets including calibrations and look-up tables. The ECU may be designed with a set of control routines executed to provide the desired functions. Control routines are executed, such as by a central processing unit, and are operable to monitor inputs from sensing devices and other networked control modules, and execute control and diagnostic routines to control operation of devices and actuators. Routines may be executed at in real-time, continuously, systematically, sporadically and/or at regular intervals, for example, each 100 microseconds, 3.125, 6.25, 12.5, 25 and 100 milliseconds, etc., during ongoing engine and vehicle operation. Alternatively, routines may be executed in response to occurrence of an event.

Figure 2:
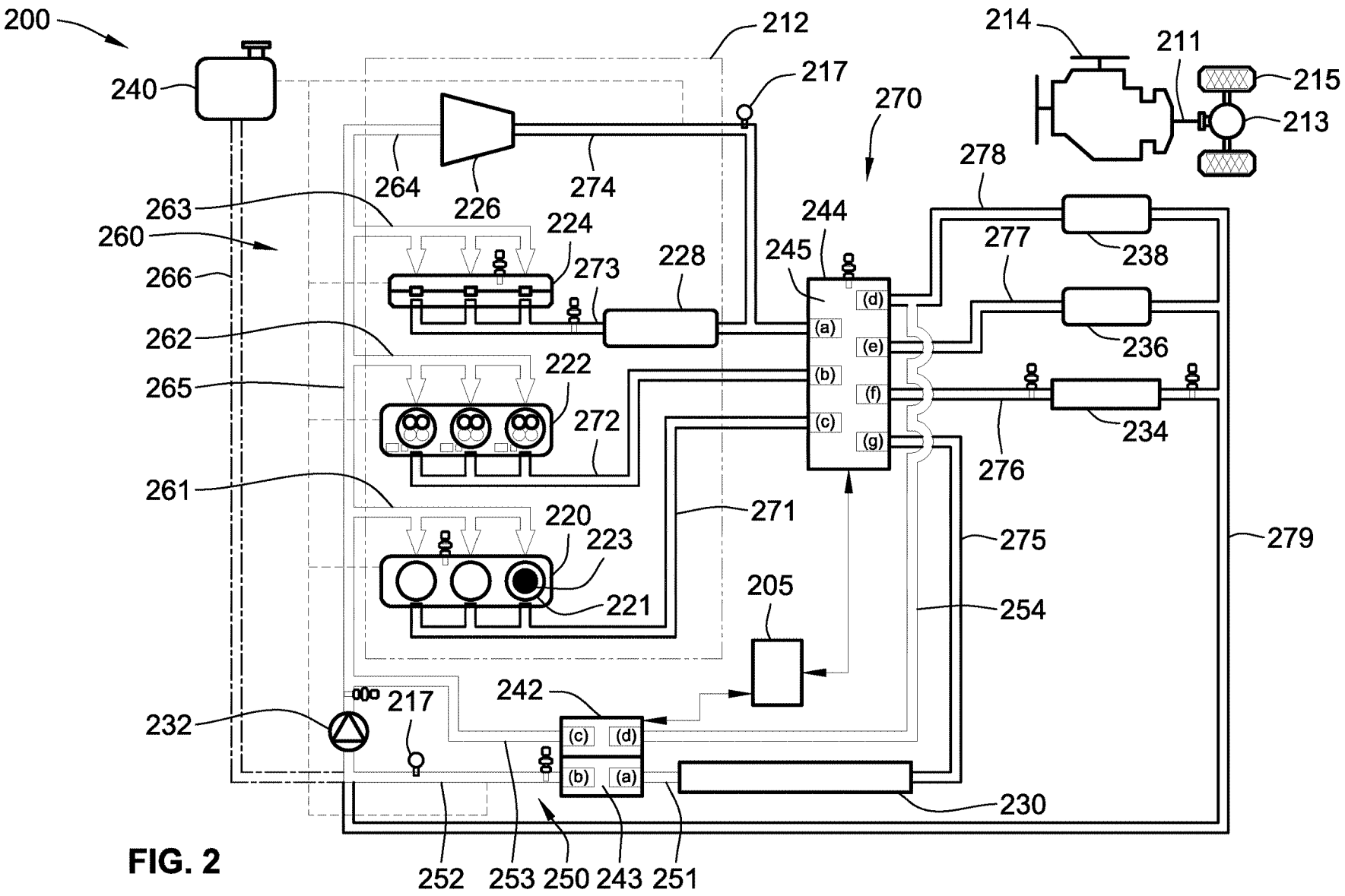
FIG. 2 is a schematic illustration of a representative multi-valve split-layout coolant system for thermal management of a motor vehicle powertrain with an automatically shifted multi-speed power transmission in accordance with aspects of the present disclosure.

Turning next to FIG. 2, there is shown a representative active thermal management system 200 with a two-valve, split-layout coolant distribution architecture for regulating the operating temperatures of various powertrain components of a motor vehicle, such as automobile 10 of FIG. 1. These powertrain components are represented, in part, via an internal combustion engine assembly 212, which may take on any of the engine configurations—including optional and alternative features—that were described above with respect to ICE assembly 12 of FIG. 1. In FIG. 2, the engine assembly 212 is an inline-three ("straight triple") carbon capture and storage (CCS) diesel engine having an engine block 220 with a cylinder head 222 mounted thereto, and an exhaust manifold 224 operatively coupled to or integrally formed with the cylinder head 222. Engine block 220 defines therein at least one or, as shown, three cylinders 221 each movably receiving therein a respective piston 223 coupled to rotate an engine output shaft, such as crankshaft 11 of FIG. 1. A multi-speed automatic transmission 214, in turn, is adapted to receive, manipulate, and distribute power from the engine 212 to a final drive system—represented herein by a driveshaft 211, rear differential 213, and a pair of rear drive wheels 215—and thereby propel the vehicle. Although not explicitly portrayed in FIG. 2, it should be appreciated that the final drive system may comprise any available configuration, e.g., front wheel drive (FWD), rear wheel drive (RWD), four-wheel drive (4WD), all-wheel drive (AWD), etc.

Similar to the cylinder head 25 of FIG. 1, cylinder head 222 of FIG. 2 is mounted, e.g., via a cylinder head gasket and bolts, to the engine block 220 in cooperative alignment with the cylinder bores 221 and pistons 223 to define a series of internal combustion chambers. A forced-induction pneumatic device, such as a turbocharger 226 having an air compressor rotationally coupled to an exhaust-gas-driven turbine, may be provided to increase the pressure and temperature of incoming air in the intake ducts, e.g., of intake manifold 29 of FIG. 1. In other applications, the turbocharger 226 may be a supercharger, a twincharger, or a variable geometry turbine (VGT) with a VGT actuator arranged to move the vanes to alter the flow of exhaust gases through the turbine. Exhaust manifold 224 may be affixed, e.g., by bolting, manifold gasket, or other fastening methods, to the side of cylinder head 222 such that the exhaust manifold 224 communicates with each exhaust port to carry exhaust gases from the internal combustion chambers to a vehicular exhaust system for subsequent release to the atmosphere. Optionally, the cylinder head 222 may be integrally formed with the exhaust manifold 224, i.e., with the exhaust runners and exhaust collector volume internally defined by the cylinder head casting to form a unitary integrated exhaust manifold (IEM). As indicated above, the engine 212 may be provided with EGR hardware, represented in FIG. 2 by a low-pressure (LP) EGR cooler 228.

FIG. 2 shows the thermal management system 200 equipped with an electronically controlled heat exchanger, represented herein by an engine radiator 230, for exchanging heat between an internally flowing liquid coolant and an external fluid medium (ambient air) and/or an internal fluid medium (refrigerant). The radiator 230 may take on any now available or hereinafter developed form, such as plate fin, serpentine fin, crossflow, parallel flow, counter flow, polymer, or metallic radiators, as well as other types of heat exchanging devices, including adiabatic and hydrodynamic heat exchangers. A hydraulic pump 232, which may be of the fixed, positive or variable displacement type, is operable for circulating liquid coolant cooled by the radiator 230 throughout the system 200. The illustrated coolant pump 232 can be a switchable water pump that is selectively engaged with and thereby driven by the engine's crankshaft. This pump 232 may be selectively engaged, for example, to pump hot coolant from the engine 212 to: a heater core 234 to warm a passenger cabin of the vehicle; an externally mounted engine oil heater (EOH) 236 for heating engine lubrication oil; and a transmission oil heater (TOH) 238 for heating transmission oil stowed in a sump volume of transmission 214. Surge tank 240 provides a temporary storage container for retaining coolant overflow due to expansion of the coolant as it heats up, and returning coolant when cooled, e.g., via the radiator 230.

ATM system 200 of FIG. 2 provides a split cooling system layout for managing heat-extracting coolant flow through the engine 212—independent flow for block 220, head 222, exhaust manifold 224, and turbocharger 226—and the transmission 214, e.g., via TOH 238. The illustrated coolant fluid circuit also allows the system 200 to manage independent heat-distributing coolant flow to the LP EGR cooler 228, radiator 230, cabin heater core 234, EOH 236, and TOH 238. With this configuration, the ATM system 200 is capable of deciding which part or parts of the engine assembly 212 to cool at a given time, and to which component or components of the vehicle powertrain will be delivered extracted engine energy in the form of heated coolant. As further described below, fluid pipes, hosing, tubes, bores, passages, channels, etc. (collectively designated herein as "conduits") filled with coolant are arranged to at least partially define three or more coolant flow loops to carry coolant from the radiator 230 to the engine 212 and transmission 214, and back to the radiator 230 in a generally closed-loop system. Coolant circulation is governed by an onboard or remote vehicle controller 205 through controlled operation of at least the pump 232 and two coolant flow control valves 242 and 244, e.g., responsive to real-time system data feedback provided by sensors 217. This vehicle controller 205 may be incorporated into, be distinct from yet collaborative with, or be fabricated as a wholly independent device from the ECU 5 of FIG. 1.

With continuing reference to FIG. 2, the ATM system 200 employs several branches of conduits for fluidly connecting the illustrated components and splitting the coolant flow among the several loops of the system. A first set of fluid conduits, designated generally as 250, fluidly connects the electronic heat exchanger 230 with the coolant pump 232, engine assembly 212, transmission 214, and first flow control valve 242. Following FIG. 2 and starting from the radiator 230, a first radiator line 251 directly fluidly connects the radiator 230 and control valve 242, while first and second radiator lines 251 and 252 of the first set 250 directly fluidly connect the radiator 230 and pump 232 through operation of the control valve 242. In the same vein, operation of the control valve 242 directly fluidly connects the radiator 230 and engine assembly 212 via first and third radiator lines 251 and 253, and the radiator 230 with TOH 238 via first and fourth radiator lines 251 and 254 of the first set 250. It is envisioned that the number, arrangement, and individual characteristics of the fluid lines in any given set of conduits may be varied from that which are shown in the drawings without departing from the intended scope of this disclosure.

A second set of fluid conduits 260 fluidly connects the coolant pump 232 to constituent parts of the engine assembly 212, including individual segments for the engine block 220, cylinder head 222, exhaust manifold 224 and turbocharger 226. This set of conduits 260 includes a main line 265 and four discrete lines 261-264 whereby select portions of coolant fluid from the radiator 230 and pump 232 are transmitted to individual sections of the engine 212. Following FIG. 2 and starting from the pump 232, the main pump line 265 and first pump line 261 directly fluidly connect the pump 232 and cylinder block 220, while main and second pump lines 265 and 262 of the second set 260 directly fluidly connect the pump 232 and cylinder head 222. Likewise, the pump 230 is directly fluidly connected to the engine's exhaust manifold 224 via main and third pump lines 265 and 263, whereas the pump 232 and turbocharger 226 are directly fluidly connected via main and fourth pump lines 265 and 264 of the second set 260. A discrete surge line 266 fluidly connects the surge tank 240 to the pump 232.

Figure 3:
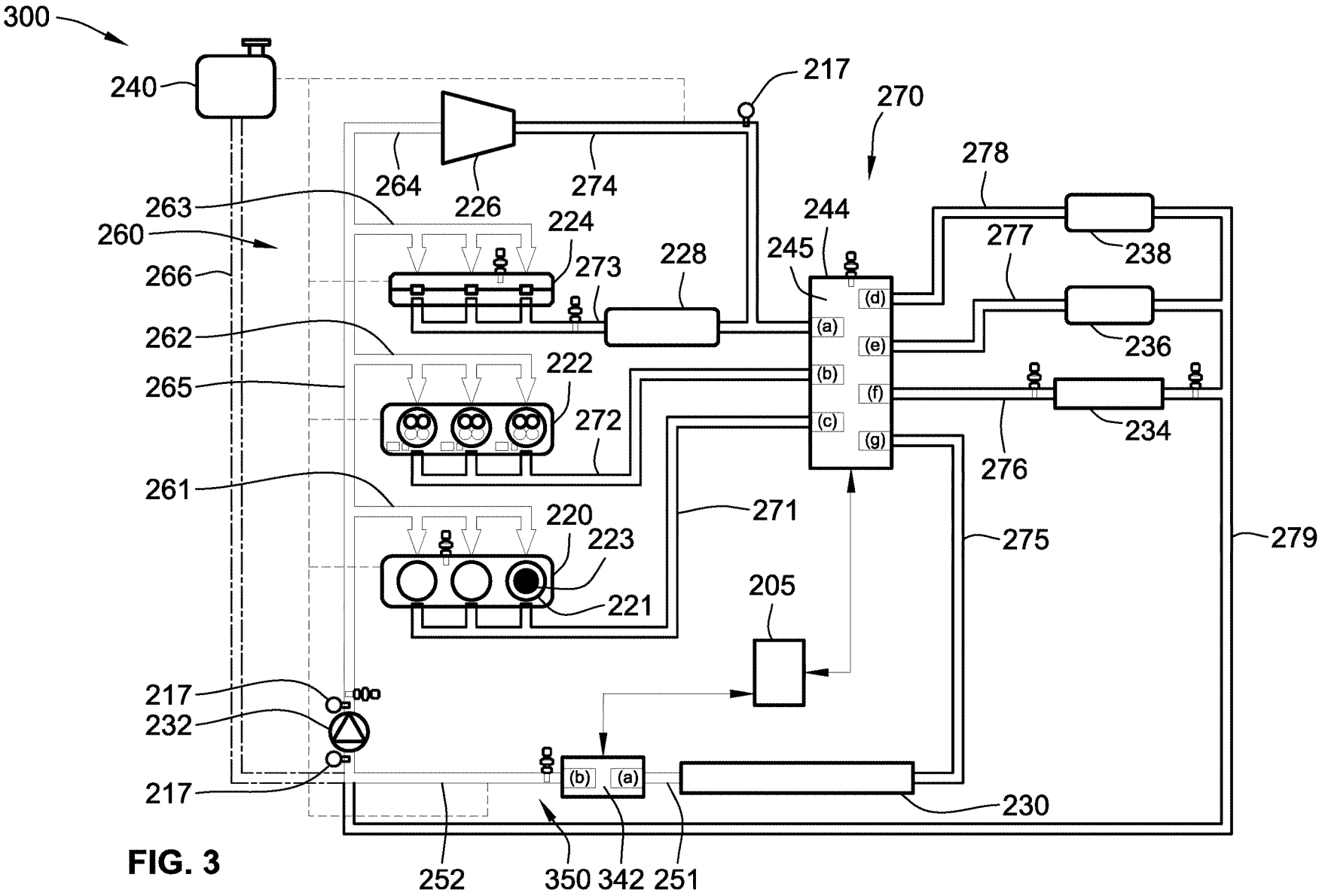
FIG. 3 is a schematic illustration of another representative multi-valve split-layout coolant system for thermal management of a motor vehicle powertrain with a manually shifted multi-speed power transmission in accordance with aspects of the present disclosure.

The ATM system 200 is also equipped with a third set of fluid conduits, designated generally as 270 in FIG. 2, for fluidly connecting the individual segments of the engine assembly 212 to the radiator 230, coolant pump 232, heater core 234, and oil heaters 236, 238. According to the illustrated example, the third set 270 employs four discrete engine lines 271-274 for individually connecting the second valve assembly 244 directly to the engine block 220 (first engine line 271), directly to the cylinder head 222 (second engine line 272), to the exhaust manifold 274 (third engine line 273), and directly to the turbocharger 226 (fourth engine line 274). As seen in FIG. 3, engine line 273 of the third set 270 fluidly connects the LP EGR cooler 228 to the second valve assembly 244. In the same vein, the third set of fluid conduits 270 employs four discrete outlet lines 275-278 for individually connecting the second valve assembly 244 directly to the radiator 230 (first outlet line 275), directly to the heater core 234 (second outlet line 276), directly to the engine oil heater 236 (third outlet line 277), and directly to the transmission oil heater 238 (fourth outlet line 278). A bypass line 279 directly fluidly connects each of the core 234, EOH 236 and TOH 238 directly to the coolant pump 232.

A pair of coolant flow control valves 242, 244 are communicatively connected to the vehicle controller 205, and selectively positionable in response to control signals received from the controller 205 to direct coolant flow through the individual lines of the coolant flow loops. While it is envisioned that these valves can take on any relevant form of electronically controlled fluid valve apparatus, the representative ATM system 200 architecture portrayed in FIG. 2 illustrates the first and second control valves 242, 244 as stepper-motor driven electric rotary valves (ERV). In particular, the first coolant flow control valve 242 may be designated as a Radiator Rotary Valve (RRV) operable for abating excessive powertrain heat by regulating the flow of cooled liquid coolant from the radiator 230 to the engine 212 and, for automatic transmission applications, to the transmission 214. As described above, the first valve assembly 242 is positioned within the first set of fluid conduits 250, interposed between and fluidly interconnected with the radiator 230 and the pump 232, engine 212 and transmission 214. Vehicle controller 205 modulates the positioning of the RRV assembly 242 to regulate coolant fluid flow: from the radiator 230 to the coolant pump 232; from the radiator 230 to the engine assembly 212; and from the radiator 230 to the TOH 238. RRV assembly 242 is composed of an RRV (first) body 243 fabricated with an inlet port (a) that is fluidly connected to the heat exchanger 230 via line 251. The RRV body 243 is also fabricated with three outlet ports: a first outlet port (b) that is fluidly connected to the pump 232 via line 252; a second outlet port (c) that is fluidly connected to the engine assembly 212 downstream from the pump 232 via line 253; and a third outlet port (d) that is fluidly connected to the TOH 238 via line 254. The RRV assembly 242 may include greater or fewer inlet and outlet ports than those shown in FIG. 2 (e.g., such as the RRV assembly 342 of FIG. 3). A flow diverter (not shown), which is rotationally secured to the valve body 243, includes multiple fluid passages providing predetermined flow paths between the inlet port and the outlet ports in response to predetermined rotational positioning of the flow diverter.

Continuing with the above example, second coolant flow control valve 244 of FIG. 2 may be designated as a Main Rotary Valve (MRV) operable for managing the coolant split inside the engine 212, and for managing the distribution of heated coolant to the transmission oil heater 238, engine oil heater 236, cabin heater 234 and radiator 232. As described above, the second valve assembly 244 is positioned within the third set of fluid conduits 270, interposed between and fluidly interconnected with the engine block 220, cylinder head 222, manifold 224, and the radiator 230, heater 234, EOH 236, TOH 238, and coolant pump 232. Vehicle controller 205 modulates the positioning of the MRV assembly 242 to regulate coolant fluid flow: (1) received by and emitted from the block 220; (2) received by and emitted from the head 222; (3) received by and emitted from the IEM 224; and (4) received by and emitted from the turbocharger 226. The positioning of a flow diverter of the MRV assembly 242 may also be modulated to regulate heated coolant fluid flow: received by the radiator 230; received by the heater 234; received by the EOH 236; received by the TOH 238; and received by pump 232.

MRV assembly 242 of FIG. 2 is composed of an MRV (second) body 245 fabricated with at least three inlet ports: a first inlet port (a) that is fluidly connected to the IEM 224 and turbocharger 226 via lines 273 and 274, respectively; a second inlet port (b) that is fluidly connected to the cylinder head 222 via line 272; and a third inlet port (c) that is fluidly connected to the engine block 220 via line 271. Optionally, the MRV body 245 may fabricated with a fourth inlet port that is fluidly connected to the turbocharger 226 such that the IEM 224 solely connects to the first inlet port (a). Antithetically, no such additional porting is required, for example, in powertrain configurations without a turbocharger or other forced-induction device. The MRV body 245 of FIG. 2 is also fabricated with at least three or, as shown, four outlet ports: a first outlet port (d) that is fluidly connected to the transmission oil heater 238 via line 278; a second outlet port (e) that is fluidly connected to the engine oil heater 238 via line 277; a third outlet port (f) that is fluidly connected to the heater core 234 and then the coolant pump 232 via lines 276 and 279, respectively; and a fourth outlet port (g) that is fluidly connected to the radiator 230 via line 275. It is envisioned that the number, arrangement, and individual characteristics of the fluid ports in any given valve may be varied from that which are shown in the drawings. Unlike some available three and four-valve split-layout coolant distribution systems, the two-valve system 200 may be characterized by a lack of a third or fourth valve assembly, e.g., interposed between and operable to control coolant flow between the engine block, cylinder head, exhaust manifold and second valve assembly or interposed between the TOH, EOH, heater core and radiator.

Referring next to FIG. 3, there is shown another representative active thermal management system, designated generally at 300, with a two-valve, split-layout coolant distribution architecture. While differing in appearance, the ATM system 300 presented in FIG. 3 may incorporate, singly, collectively, or in any combination, any of the features and options disclosed above with reference to the ATM system 200 of FIG. 2, and vice versa. By way of non-limiting example, ATM system 300 is equipped with an electronically controlled heat exchanger 230 and hydraulic pump 232, each of which may be similar to or distinct from their counterpart described above with respect to FIG. 2. A surge tank 240 provides storage for holding and returning coolant overflow due to expansion and contraction of coolant fluid. ATM system 300 of FIG. 3 also provides a split cooling system layout for managing heat-extracting coolant flow through an engine 212 with independent flow for an engine block 220, a cylinder head 222, an exhaust manifold 224, and a turbocharger 226. Coolant circulation is governed by a programmable vehicle controller 205 through controlled operation of at least the pump 232 and two coolant flow control valves 342 and 244.

Similar to ATM system 200, the ATM system 300 of FIG. 3 employs several branches of conduits for fluidly connecting the illustrated components and splitting the coolant flow among the several loops of the system. A first set of fluid conduits, designated generally as 350, fluidly connects the electronic heat exchanger 230 with the coolant pump 232 via a first flow control valve 342. In this example, a first radiator line 251 directly fluidly connects the radiator 230 and control valve 342, while first and second radiator lines 251 and 252 of the first set 250 directly fluidly connect the radiator 230 and pump 232 through operation of the first flow control valve 342. By way of contrast to the representative architecture of FIG. 2, the first set of fluid conduits 350 may lack third and fourth fluid lines for directly fluidly connecting the radiator 230 to the engine assembly 212 and transmission 214. In the same vein, the body of RRV assembly 342 is fabricated with a single outlet port (b) that fluidly connects to the pump 232 via line 252; the RRV assembly 342 may be said to lack a second and/or a third outlet port for fluidly connecting the valve body directly to the engine assembly 212 and the TOH 238.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A thermal management system for a vehicle powertrain, the vehicle powertrain including an oil heater and an engine assembly with an engine block, a cylinder head, and an exhaust manifold, the thermal management system comprising:

an electronic heat exchanger configured to actively transfer heat from a coolant fluid to an ambient fluid;

a coolant pump configured to circulate the coolant fluid emitted from the electronic heat exchanger;

a first set of fluid conduits fluidly connecting the coolant pump and the electronic heat exchanger;

a second set of fluid conduits configured to fluidly connect the coolant pump to the engine block, the cylinder head, and the exhaust manifold;

a third set of fluid conduits configured to fluidly connect the engine block, the cylinder head, and the exhaust manifold to the electronic heat exchanger, the coolant pump, and the oil heater;

a first valve assembly interposed within the first set of fluid conduits and operable to regulate coolant fluid flow between the coolant pump and the electronic heat exchanger; and a second valve assembly interposed within the third set of fluid conduits and operable to regulate coolant fluid flow, individually and jointly, between the engine block, the cylinder head, the exhaust manifold, the electronic heat exchanger, the coolant pump, and the oil heater, the second valve assembly including a second body with a first inlet port configured to fluidly connect to the exhaust manifold, a second inlet port configured to fluidly connect to the cylinder head, and a third inlet port configured to fluidly connect to the engine block.

2. The thermal management system of claim 1, wherein the second body of the second valve assembly further includes a first outlet port configured to fluidly connect to the oil heater, a third outlet port configured to fluidly connect to the coolant pump, and a fourth outlet port configured to fluidly connect to the electronic heat exchanger.

3. The thermal management system of claim 2, wherein the oil heater is an engine oil heater, the vehicle powertrain further including a multi-speed power transmission with a transmission oil heater, and wherein the second body of the second valve assembly further includes a second outlet port configured to fluidly connect to the transmission oil heater.

4. The thermal management system of claim 1, wherein the first valve assembly includes a first body with a first inlet port fluidly connected to the electronic heat exchanger, and a first outlet port fluidly connected to the coolant pump.

5. The thermal management system of claim 4, wherein the first body of the first valve assembly further includes a second outlet port configured to fluidly connect to the oil heater, and a third outlet port configured to fluidly connect to the engine block, the cylinder head, and the exhaust manifold downstream from the coolant pump.

6. The thermal management system of claim 1, wherein the second set of fluid conduits includes three discrete lines configured to individually connect the engine block, the cylinder head, and the exhaust manifold to the coolant pump.

7. The thermal management system of claim 1, wherein the third set of fluid conduits includes three discrete fluid lines configured to individually connect the engine block, the cylinder head, and the exhaust manifold to respective inlet ports of the second valve assembly, and three discrete fluid lines configured to individually connect the electronic heat exchanger, the coolant pump, and the oil heater to respective outlet ports of the second valve assembly.

8. The thermal management system of claim 1, wherein the vehicle powertrain further includes an exhaust gas recirculation (EGR) cooler, and wherein the third set of fluid conduits is further configured to fluidly connect the EGR cooler to the second valve assembly.

9. The thermal management system of claim 1, wherein the vehicle powertrain further includes a turbocharger device, and wherein the second set of fluid conduits is further configured to fluidly connect the coolant pump to the turbocharger device.

10. The thermal management system of claim 1, further comprising a cabin heater core operable to warm a passenger cabin of a motor vehicle, wherein the cabin heater core is interposed between and fluidly connected to the second valve assembly and the coolant pump via a respective branch of the third set of fluid conduits.

11. The thermal management system of claim 1, characterized by a lack of a third valve assembly interposed between and operable to control coolant flow between the engine block, the cylinder head, the exhaust manifold and the second valve assembly.

12. The thermal management system of claim 1, further comprising an electronic controller communicatively connected to and configured to regulate selective operation of the first and second valve assemblies.

13. A thermal management system for a vehicle powertrain, the vehicle powertrain including an oil heater and an engine assembly with an engine block, a cylinder head, and an exhaust manifold, the thermal management system comprising:

an electronic heat exchanger configured to actively transfer heat from a coolant fluid to an ambient fluid;

a coolant pump configured to circulate the coolant fluid emitted from the electronic heat exchanger;

a first set of fluid conduits fluidly connecting the coolant pump and the electronic heat exchanger;

a second set of fluid conduits configured to fluidly connect the coolant pump to the engine block, the cylinder head, and the exhaust manifold;

a third set of fluid conduits configured to fluidly connect the engine block, the cylinder head, and the exhaust manifold to the electronic heat exchanger, the coolant pump, and the oil heater;

a first valve assembly interposed within the first set of fluid conduits and operable to regulate coolant fluid flow between the coolant pump and the electronic heat exchanger, the first valve assembly including a first body with a first inlet port fluidly connected to the electronic heat exchanger, a first outlet port fluidly connected to the coolant pump, a second outlet port configured to fluidly connect to the oil heater, and a third outlet port configured to fluidly connect to the engine block, the cylinder head, and the exhaust manifold; and a second valve assembly interposed within the third set of fluid conduits and operable to regulate coolant fluid flow, individually and jointly, between the engine block, the cylinder head, the exhaust manifold, the electronic heat exchanger, the coolant pump, and the oil heater.

14. The thermal management system of claim 13, wherein the second valve assembly includes a second body with a first inlet port configured to fluidly connect to the exhaust manifold, a second inlet port configured to fluidly connect to the cylinder head, and a third inlet port configured to fluidly connect to the engine block.

15. The thermal management system of claim 14, wherein the second body of the second valve assembly further includes a first outlet port configured to fluidly connect to the oil heater, a third outlet port configured to fluidly connect to the coolant pump, and a fourth outlet port configured to fluidly connect to the electronic heat exchanger.

16. The thermal management system of claim 13, wherein the second set of fluid conduits includes three discrete lines configured to individually connect the engine block, the cylinder head, and the exhaust manifold to the coolant pump.

17. The thermal management system of claim 13, wherein the vehicle powertrain further includes an exhaust gas recirculation (EGR) cooler, and wherein the third set of fluid conduits is further configured to fluidly connect the EGR cooler to the second valve assembly.

18. The thermal management system of claim 13, wherein the third set of fluid conduits includes three discrete fluid lines configured to individually connect the engine block, the cylinder head, and the exhaust manifold to respective inlet ports of the second valve assembly, and three discrete fluid lines configured to individually connect the electronic heat exchanger, the coolant pump, and the oil heater to respective outlet ports of the second valve assembly.

19. The thermal management system of claim 13, further comprising a cabin heater core operable to warm a passenger cabin of a motor vehicle, wherein the cabin heater core is interposed between and fluidly connected to the second valve assembly and the coolant pump via a respective branch of the third set of fluid conduits.

20. A thermal management system for a vehicle powertrain, the vehicle powertrain including an oil heater and an engine assembly with an engine block, a cylinder head, and an exhaust manifold, the thermal management system comprising:

an electronic heat exchanger configured to actively transfer heat from a coolant fluid to an ambient fluid;

a coolant pump configured to circulate the coolant fluid emitted from the electronic heat exchanger;

a first set of fluid conduits fluidly connecting the coolant pump and the electronic heat exchanger;

a second set of fluid conduits configured to fluidly connect the coolant pump to the engine block, the cylinder head, and the exhaust manifold;

a third set of fluid conduits configured to fluidly connect the engine block, the cylinder head, and the exhaust manifold to the electronic heat exchanger, the coolant pump, and the oil heater;

a first valve assembly interposed within the first set of fluid conduits and operable to regulate coolant fluid flow between the coolant pump and the electronic heat exchanger; and a second valve assembly interposed within the third set of fluid conduits and operable to regulate coolant fluid flow, individually and jointly, between the engine block, the cylinder head, the exhaust manifold, the electronic heat exchanger, the coolant pump, and the oil heater, wherein the third set of fluid conduits includes three discrete fluid lines configured to individually connect the engine block, the cylinder head, and the exhaust manifold to respective inlet ports of the second valve assembly, and three discrete fluid lines configured to individually connect the electronic heat exchanger, the coolant pump, and the oil heater to respective outlet ports of the second valve assembly.

* * * * *